US010773303B2

(12) United States Patent
Liang et al.

(10) Patent No.: US 10,773,303 B2
(45) Date of Patent: Sep. 15, 2020

(54) SPARK PLASMA SINTERED POLYCRYSTALLINE DIAMOND COMPACT

(71) Applicant: Halliburton Energy Services, Inc., Houston, TX (US)

(72) Inventors: Qi Liang, Richmond, VA (US); William Brian Atkins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 15/742,455

(22) PCT Filed: Aug. 5, 2015

(86) PCT No.: PCT/US2015/043802
§ 371 (c)(1),
(2) Date: Jan. 5, 2018

(87) PCT Pub. No.: WO2017/023315
PCT Pub. Date: Feb. 9, 2017

(65) Prior Publication Data

US 2018/0200789 A1 Jul. 19, 2018

(51) Int. Cl.
*B22F 3/105* (2006.01)
*B22F 3/11* (2006.01)
(Continued)

(52) U.S. Cl.
CPC ..... *B22F 3/105* (2013.01); *B22F 3/11* (2013.01); *B22F 7/06* (2013.01); *B22F 7/08* (2013.01);
(Continued)

(58) Field of Classification Search
CPC ..... B22F 3/105; B22F 7/08; B22F 2005/001; B22F 2302/10; B22F 2302/406
See application file for complete search history.

(56) References Cited

U.S. PATENT DOCUMENTS 4,919,974 A 4/1990 McCune et al.
5,116,568 A 5/1992 Sung et al.
(Continued)

FOREIGN PATENT DOCUMENTS

CN 1320108 10/2001
CN 102356211 2/2012
(Continued)

OTHER PUBLICATIONS

Kodash et al. ("Field-assisted sintering of Ni nanopowders." Materials Science and Engineering: A 385.1-2 (2004): 367-371). (Year: 2004).*
(Continued)

*Primary Examiner* — Anthony J Zimmer
*Assistant Examiner* — Ricardo D Morales
(74) *Attorney, Agent, or Firm* — Baker Botts L.L.P.

(57) ABSTRACT

The present disclosure relates to polycrystalline diamond covalently bonded to a substrate by spark plasma sintering and methods of covalently bonding polycrystalline diamond and a substrate. Spark plasma sintering produces plasma from a reactant gas found in the pores in the polycrystalline diamond and, optionally, also the substrate. The plasma forms carbide structures in the pores, which covalently bond to the substrate.

20 Claims, 5 Drawing Sheets

(51) Int. Cl.

| | |
|---|---|
| ***B22F 7/06*** | (2006.01) |
| ***C22C 26/00*** | (2006.01) |
| ***B22F 7/08*** | (2006.01) |
| ***B22F 5/00*** | (2006.01) |
| ***C22C 29/06*** | (2006.01) |

(52) U.S. Cl.

CPC ..... *C22C 26/00* (2013.01); *B22F 2005/001* (2013.01); *B22F 2302/10* (2013.01); *B22F 2302/406* (2013.01); *B22F 2999/00* (2013.01); *C22C 29/06* (2013.01)

(56) References Cited

U.S. PATENT DOCUMENTS

| | | | | |
|---|---|---|---|---|
| 5,158,148 | A | 10/1992 | Keshavan | |
| 5,349,154 | A | 9/1994 | Harker et al. | |
| 5,584,045 | A * | 12/1996 | Tanabe | C23C 16/01 428/547 |
| 5,718,736 | A | 2/1998 | Onishi et al. | |
| 6,214,079 | B1 | 4/2001 | Kear et al. | |
| 6,344,149 | B1 | 2/2002 | Oles | |
| 6,861,137 | B2 | 3/2005 | Griffin et al. | |
| 7,407,012 | B2 | 8/2008 | Keshavan et al. | |
| 7,528,413 | B2 | 5/2009 | Yoshida et al. | |
| 7,533,740 | B2 | 5/2009 | Zhang et al. | |
| 8,080,071 | B1 | 12/2011 | Vail | |
| 8,372,334 | B2 | 2/2013 | Voronin et al. | |
| 8,414,986 | B2 | 4/2013 | Keshavan | |
| 8,617,274 | B2 | 12/2013 | Zhan et al. | |
| 8,662,209 | B2 | 3/2014 | Dourfaye et al. | |
| 8,720,612 | B2 | 5/2014 | Corbett et al. | |
| 8,727,042 | B2 | 5/2014 | DiGiovanni | |
| 8,727,043 | B2 | 5/2014 | Zhang et al. | |
| 8,919,463 | B2 | 12/2014 | Setlur et al. | |
| 9,447,642 | B2 | 9/2016 | Bellin et al. | |
| 9,862,606 | B1 | 1/2018 | Cook et al. | |
| 2002/0119303 | A1 | 8/2002 | Pender et al. | |
| 2005/0044800 | A1 | 3/2005 | Hall et al. | |
| 2005/0050801 | A1 | 3/2005 | Cho et al. | |
| 2007/0029114 | A1 | 2/2007 | Middlemiss | |
| 2009/0152018 | A1 | 6/2009 | Sani | |
| 2010/0206941 | A1 | 8/2010 | Egan et al. | |
| 2010/0243336 | A1 | 9/2010 | Dourfaye et al. | |
| 2011/0024201 | A1* | 2/2011 | Scott | E21B 10/567 175/428 |
| 2011/0036641 | A1 | 2/2011 | Lyons | |
| 2011/0083908 | A1 | 4/2011 | Shen et al. | |
| 2011/0226532 | A1 | 9/2011 | Jonker et al. | |
| 2012/0097457 | A1* | 4/2012 | Setlur | E21B 10/573 175/428 |
| 2012/0291361 | A1 | 11/2012 | Frushour | |
| 2013/0068450 | A1 | 3/2013 | Phadke et al. | |
| 2013/0086847 | A1 | 4/2013 | Digiovanni et al. | |
| 2013/0133957 | A1 | 5/2013 | Belnap et al. | |
| 2014/0020823 | A1 | 1/2014 | Montross | |
| 2014/0060937 | A1 | 3/2014 | Konovalov et al. | |
| 2014/0123565 | A1 | 5/2014 | Zhan et al. | |
| 2014/0360103 | A1 | 12/2014 | DiGiovanni et al. | |
| 2017/0183235 | A1 | 6/2017 | Liang et al. | |

FOREIGN PATENT DOCUMENTS

| | | |
|---|---|---|
| CN | 103038380 | 4/2013 |
| CN | 103260799 | 8/2013 |
| CN | 104712252 | 6/2015 |
| EP | 1760165 | 3/2007 |
| WO | 18702 | 4/2000 |
| WO | 01/79583 | 10/2001 |
| WO | 2010/034492 | 4/2010 |
| WO | 2011141898 | 11/2011 |
| WO | 2012/158322 | 11/2012 |

OTHER PUBLICATIONS

"Polycrystalline Diamond Cutters Produced Via Spark Plasma Infiltration." National Oilwell Varco, Oct. 10, 2013; 2 pages.

International Search Report received for PCT Patent Application No. PCT/US2015/043791, dated May 3, 2016; 12 pages.

International Search Report received for PCT Patent Application No. PCT/US2015/043802, dated May 3, 2016; 12 pages.

Zhao, Yucheng, and Mingzhi Wang. "Effect of sintering temperature on the structure and properties of polycrystalline cubic boron nitride prepared by SPS." Journal of materials processing technology 209.1 (2009): 355-359; 14 pages.

Office Action for Chinese Application No. 201580081302.9, dated Jan. 28, 2019, no English translation; 8 pages.

Office Action for Chinese Application No. 201580081302.9, dated Jul. 11, 2019, no English translation; 6 pages.

International Preliminary Report on Patentability for PCT Patent Application No. PCT/US2015/043791, dated Feb. 15, 2018; 8 pages.

International Preliminary Report on Patentability for PCT Patent Application No. PCT/US2015/043802, dated Feb. 15, 2018; 8 pages.

PDC drill bits, petrowiki.org/PDC_drill_bits, 3 pages, Jan. 19, 2016.

Fang, Z. Zak, et al. "Synthesis, sintering, and mechanical properties of nanoctystalline cemented tungsten carbide—a review." International Journal of Refractory Metals and Hard Materials 27.2 (2009): 288-299; 12 pages.

International Search Report and Written Opinion, Application No. PCT/US2015/043771; 11 pgs, dated Aug. 5, 2015.

* cited by examiner

SPARK PLASMA SINTERED POLYCRYSTALLINE DIAMOND COMPACT

RELATED APPLICATIONS

This application is a U.S. National Stage Application of International Application No. PCT/US2015/043802 filed Aug. 5, 2015, which designates the United States, and which is incorporated herein by reference in its entirety.

TECHNICAL FIELD

The present disclosure relates to polycrystalline diamond compact (PDC) including polycrystalline diamond bonded to a substrate by spark plasma sintering.

BACKGROUND

Polycrystalline diamond compacts (PDCs), particularly PDC cutters, are often used in earth-boring drill bits, such as fixed cutter drill bits. PDCs include diamond formed under high-pressure, high-temperature (HTHP) conditions in a press. In many cases, a PDC includes polycrystalline diamond formed and bonded to a substrate in as few as a single HTHP press cycle. A sintering aid, sometimes referred to in the art as a catalysing material or simply a "catalyst," is often included in the press to facilitate the diamond-diamond bonds that participate both in forming the diamond and, optionally, in bonding the diamond to the substrate.

During use (e.g. while drilling), polycrystalline diamond cutters become very hot, and residual sintering aid in the diamond can cause problems such as premature failure or wear due to factors including a mismatch between the coefficients of thermal expansion (i.e. CTE mismatch) of diamond and the sintering aid. To avoid or minimize this issue, all or a substantial portion of the residual diamond sintering aid is often removed from the polycrystalline diamond prior to use, such as via a chemical leaching process, an electrochemical process, or other methods. Polycrystalline diamond from which at least some residual sintering aid has been removed is often referred to as leached regardless of the method by which the diamond sintering aid was removed. Polycrystalline diamond sufficiently leached to avoid graphitization at temperatures up to 1200° C. at atmospheric pressure is often referred to as thermally stable. PDCs containing leached or thermally stable polycrystalline diamond are often referred to as leached or thermally stable PDCs, reflective of the nature of the polycrystalline diamond they contain.

Although the polycrystalline diamond used in a PDC is typically formed on a substrate, the formation substrate may be subsequently removed, for example to facilitate leaching. Even if the PDC contains polycrystalline diamond on the original substrate, the bond between the polycrystalline diamond and the original substrate may have been weakened, for instance by leaching. Thus, attachment of polycrystalline diamond to a substrate or improving an existing attachment of polycrystalline diamond to a substrate is of interest.

BRIEF DESCRIPTION OF THE DRAWINGS

A more complete and thorough understanding of the present embodiments and advantages thereof may be acquired by referring to the following description taken in conjunction with the accompanying drawings, which are not to scale, in which like reference numbers indicate like features, and wherein.

DETAILED DESCRIPTION

The present disclosure relates to a s PDC element, such as a PDC cutter, containing leached polycrystalline diamond covalently bonded to a substrate by spark plasma sintering. The plasma used in spark plasma sintering contains carbide structure-forming elements that covalently bond to the polycrystalline diamond and to carbide particles in the substrate, forming covalent carbide bonds between them.

Polycrystalline diamond, particularly if leached, more particularly if sufficiently leached to be thermally stable, contains pores in which the carbide structures form. When the pores in the polycrystalline diamond are adjacent to the carbide grains in the substrate, carbide structures form within and covalently bond to the walls of the pores and also covalently bond to the carbide grains in the substrate. Within the polycrystalline diamond, diamond bonds may also form within the pores.

Figure 1A:
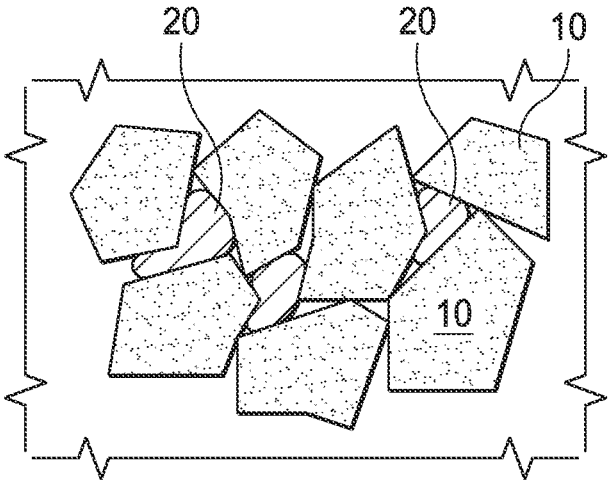
FIG. 1A is a schematic drawing in cross-section of unleached polycrystalline diamond.
Figure 1B:
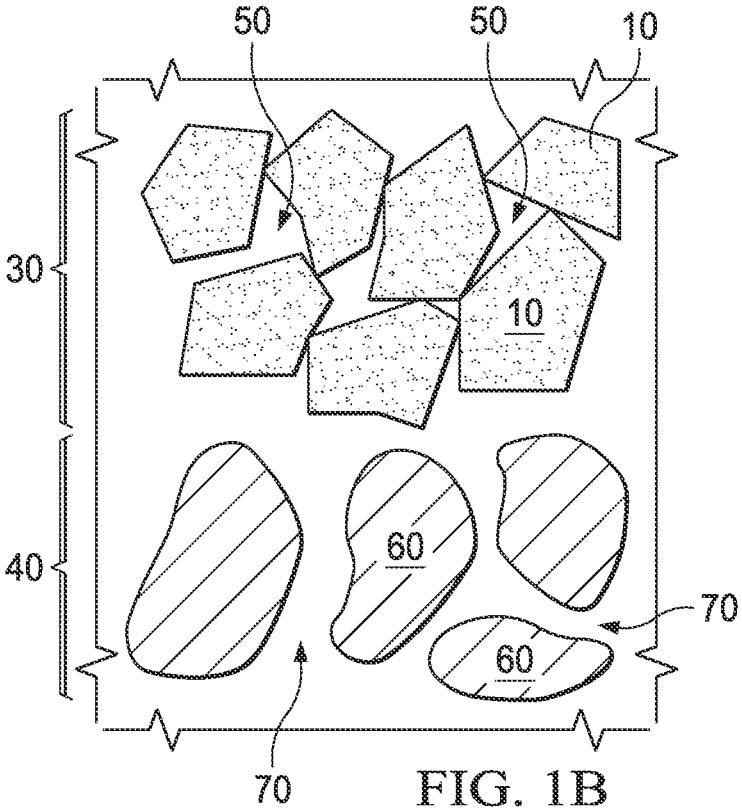
FIG. 1B is a schematic drawing in cross-section of leached polycrystalline diamond adjacent, but not covalently bonded to, a substrate.

FIG. 1A depicts unleached polycrystalline diamond. Diamond sintering aid 20, in the form of a catalyst, is located between diamond grains 10. After leaching, as illustrated in by fully leached polycrystalline diamond 30 of FIG. 1B, pores 50 are present where diamond sintering aid 20 was previously located. Although FIG. 1B illustrates fully leached, thermally stable polycrystalline diamond, partially leached polycrystalline diamond or unleached polycrystalline diamond with pores may also be used with spark plasma sintering processes disclosed herein. The leached portion of the polycrystalline diamond may extend to any depth from the surface of the polycrystalline diamond or even include all of the polycrystalline diamond. Less than 2% or less than 1% of the volume of the leached portion of leached or thermally stable polycrystalline diamond is occupied by diamond sintering aid, as compared to between 4% and 8% of the volume in unleached polycrystalline diamond.

Pores 70 may be present in substrate 40 surrounding carbide grains 60. Alternatively, substrate 40 may lack pores or may contain other material around carbide grains 60. In either case, substrate 40 may be a cemented carbide containing a matrix in which carbide grains 60 and pores 70 are located.

Figure 1C:
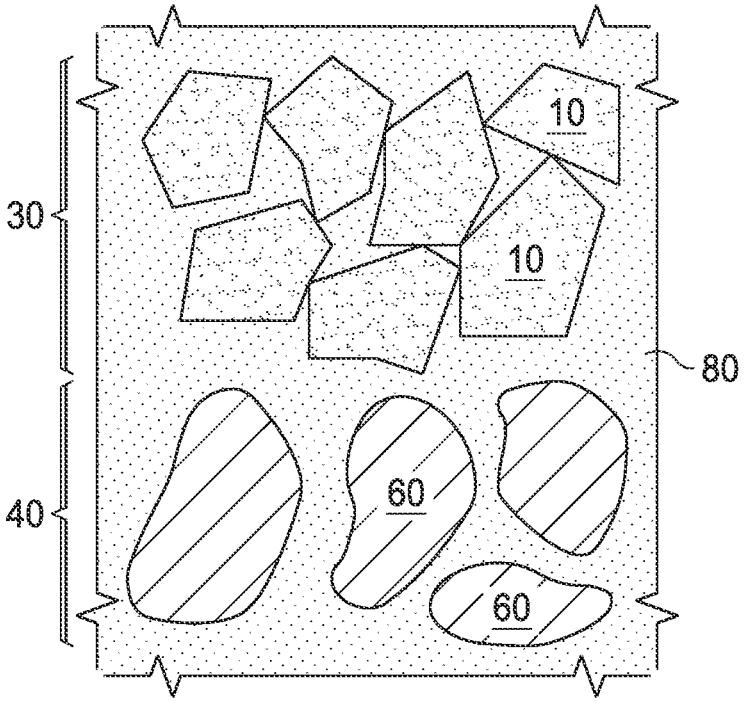
FIG. 1C is schematic drawing in cross-section of leached polycrystalline diamond adjacent a substrate in the presence of a reactant gas prior to covalent bonding by spark plasma sintering.

During a spark plasma sintering process, pores 50 and 70 are filled with reactant gas 80, as shown in FIG. 1C.

Although all pores 50 and 70 are illustrated as filled in FIG. 1C, not all pores need necessarily be filled. At least a portion of the pores, at least 25% of the pores, at least 50% of the pores, at least 75% of the mores, or at least 99% of the pores in either polycrystalline diamond 30, substrate 40, or both may be filled with reactant gas. Alternatively, at least 95% of the pores, at least 90% of the pores, or at least 75% of the pores in polycrystalline diamond 30 within 500 μm of the interface between polycrystalline diamond 30 and substrate 40 may be filled with reactive gas. Pore filling is evidenced by formation of diamond bonds or carbide structures in the pores after spark plasma sintering.

Although substrate 40 may have pores throughout in some instances, in others it may also generally lack pores, in which case it may be modified or prepared to introduce pores 70 near its surface adjacent polycrystalline diamond 30, for instance within 500 μm of the substrate surface adjacent polycrystalline diamond 30. Preparation or modification may include dissolving a portion of the substrate, for instance using an acid. In the case of a cemented carbide substrate, acid typically dissolves the matrix before it dissolves carbide grains 60, leaving pores where the matrix once was. Preparation or modification may also include mechanical abrasion, which may not selectively remove matrix from a cemented carbide. These modifications or preparations typically take place prior to placing substrate 40 adjacent to polycrystalline diamond 30.

If substrate 40 generally lacks pores and is not modified or prepared to form pores on its surface adjacent the polycrystalline diamond, carbide structures 100 will covalently bond to available carbide grains 60, typically those at the surface of substrate 40 adjacent polycrystalline diamond 30.

Figure 1D:
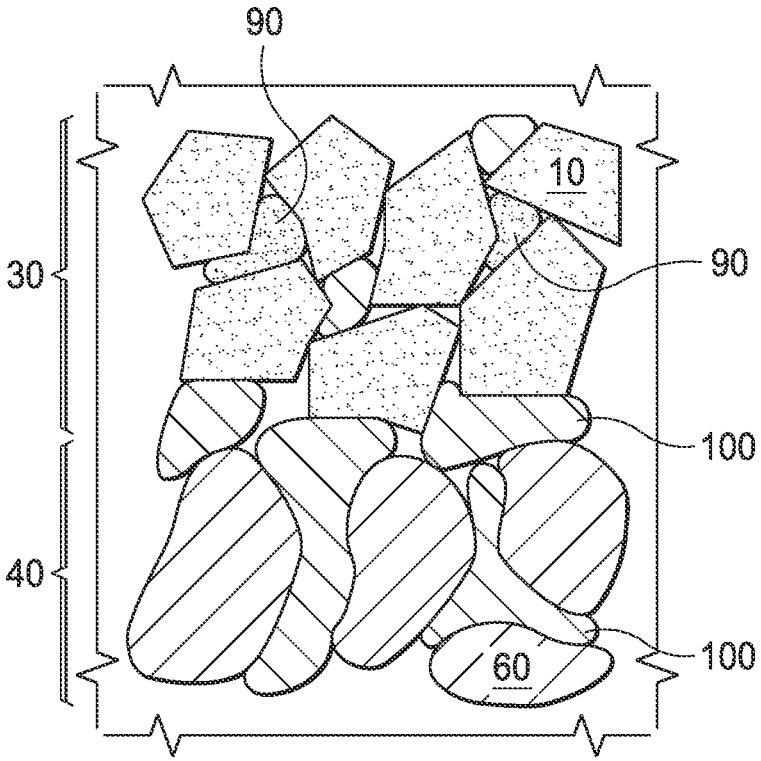
FIG. 1D is a schematic drawing in cross-section of a leached PDC cutter including polycrystalline diamond and a substrate covalently bonded by spark plasma sintering.

Finally, in the spark plasma sintered PDC illustrated in FIG. 1D, pores 50 are filled with diamond bonds 90 and/or carbide structures 100 that are formed from reactant gas 80. In addition pores 70 in substrate 40 are filled with carbide structures 100 that are formed from reactant gas 80. Carbide structures 100 at the interface between polycrystalline diamond 30 and substrate 40 may covalently bond to carbide grains 60 and diamond grains 10. These structures spanning the interface may be particularly useful in covalently bonding polycrystalline diamond 30 to substrate 40.

In FIG. 1D, carbide structures 100 are illustrated as distinguishable from carbide grains 60, but they may be so similar and/or may fill any pores so thoroughly that they are not distinguishable, particularly if carbide grains 60 and carbide structures 100 are formed from the same material. Similarly, although diamond bonds 90 are illustrated as distinguishable from diamond grains 10, they may not be in some instances.

Furthermore, although each filled pore in FIG. 1D is illustrated as not entirely filled, it is possible for each filled pore to be substantially filled in one or both of the polycrystalline diamond 30 and substrate 40. Furthermore, although FIG. 1D illustrates some pores as unfilled, the disclosure include embodiments in which diamond bonds and/or carbide structures fill at least 25% of the pores, at least 50% of the pores, at least 75% of the mores, or at least 99% of the pores in polycrystalline diamond 30 and/or substrate 40.

A higher percentage of filled pores and more complete filling of filled pores 50 and 70 adjacent substrate 40 and polycrystalline diamond 30, respectively, typically results in a stronger covalent bonding between the polycrystalline diamond and the substrate, making the bonded area less likely to fail during use of the PDC. It may also result in a more dense PDC or a PDC with higher impact strength.

Diamond grains 10 may be of any size suitable to form polycrystalline diamond 30. They may vary in grain size throughout the polycrystalline diamond or in different regions of the polycrystalline diamond. For example, diamond grains 10 may be larger near the interface between polycrystalline diamond 30 and substrate 40 in order to provide more or larger pores 50, and smaller near the working surface of polycrystalline diamond 30 to provide beneficial properties, such as higher abrasion resistance, than are achievable with larger diamond grains.

Carbide grains 60 may include any carbide, particularly tungsten carbide (WC) or another carbide also capable of forming a carbide structure as described below. Substrate 40 may include one or more matrix materials (not shown), such as binders and/or infiltrants, in addition to carbide grains 60. These matrix materials surround carbide grains 60 to form a cemented carbide. The binder and/or infiltrant may, in particular, be a metallic composition, such as a metal or metal alloy.

Reactant gas 80 may include a carbide-forming metal in gas form alone or in combination with hydrogen gas ($H_2$) and/or a hydrocarbon gas. The carbide-forming metal may include zirconium (Zr), titanium (Ti), silicon (Si), vanadium (V), chromium (Cr), boron (B), tungsten (W), tantalum (Ta), manganese (Mn), nickel (Ni), molybdenum (Mo), halfnium (Hf), rehenium (Re) and any combinations thereof. The gas form may include a salt of the metal, such as a chloride, or another compound containing the metal rather than the unreacted element, as metal compounds often form a gas more readily than do unreacted elemental metals. The hydrocarbon gas may include methane, acetone, methanol, or any combinations thereof.

Carbide structures may include transitional phases of metal elements, such as zirconium carbide (ZrC), titanium carbide (TiC), silicon carbide (SiC), vanadium carbide (VC), chromium carbide (CrC), boron carbide (BC), tungsten carbide (WC), tantalum carbide (TaC), manganese carbide (MnC), nickel carbide (NiC), molybdenum carbide (MoC), halfnium carbide (HfC), rhenium carbide (ReC), and any combinations thereof.

Figure 2:
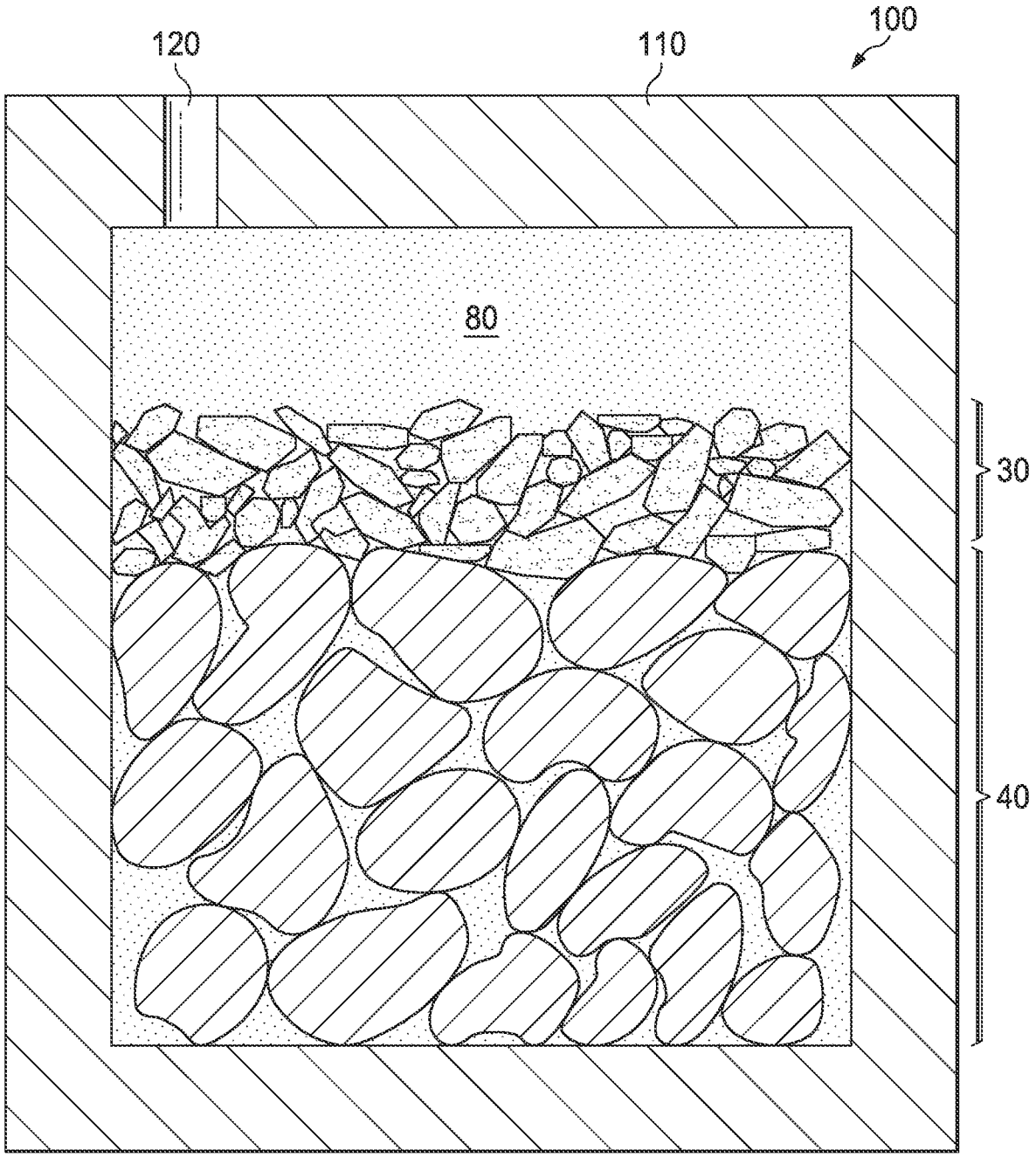
FIG. 2 is a schematic drawing in cross-section of a spark plasma sintering assembly.

Prior to spark plasma sintering, polycrystalline diamond 30 and substrate 40 are placed in a spark plasma sintering assembly 100, such as the assembly of FIG. 2. The assembly includes a sealed sintering can 110 containing polycrystalline diamond 30 and substrate 40 with a reactant gas 80 adjacent to polycrystalline diamond 30. Sealed sintering can 110 includes port 120 through which reactant gas 80 enters sealed sintering can 110 before it is sealed. Reactant gas 80 may be introduced into sealed sintering can 110 before it is placed in spark plasma sintering assembly 200 of FIG. 3 by placing can 110 in a vacuum to remove internal air, then pumping reactant gas 80 into the vacuum chamber. The vacuum chamber may be different from chamber 210 of spark plasma sintering assembly 200, or it may be chamber 210. Port 120 may be sealed with any material able to withstand the spark plasma sintering process, such as a braze alloy.

Sealed sintering can 110 is typically formed from a metal or metal alloy or another electrically conductive material. However, it is also possible to form sealed sintering can from a non-conductive material and then place it within a conductive sleeve, such as a graphite sleeve. A conductive sleeve or non-conductive sleeve may also be used with a conductive sintering can 110 to provide mechanical reinforcement. Such sleeves or other components attached to or fitted around all or part of sintering can 110 may be considered to be part of the sintering can.

Figure 3:
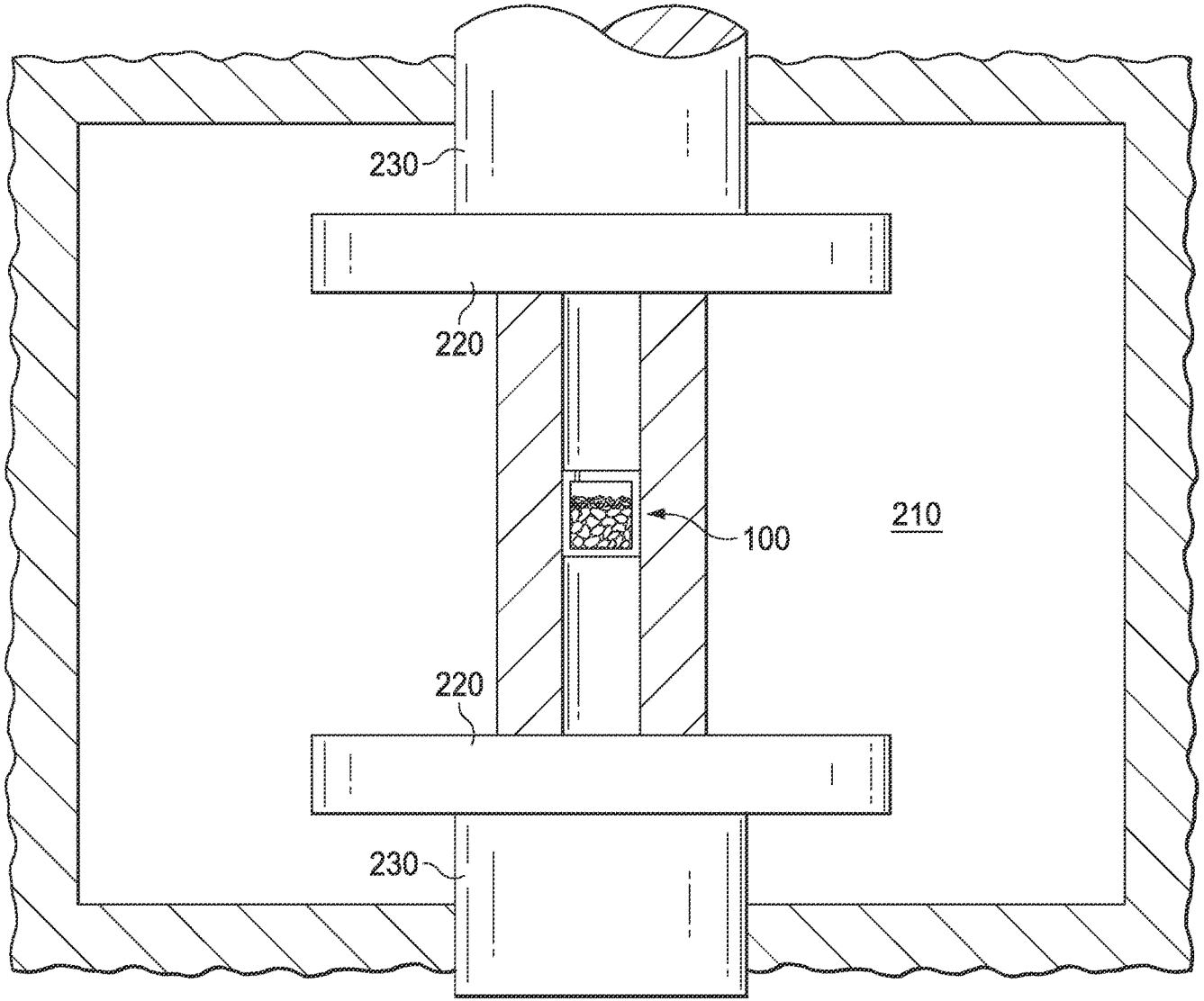
FIG. 3 is a schematic drawing of a spark plasma sintering system containing the assembly of FIG. 2.

During spark plasma sintering (also sometimes referred to as field assisted sintering technique or pulsed electric current sintering) a sintering assembly, such as assembly 100 of FIG. 2, is placed in a spark plasma sintering system, such as system 200 of FIG. 3. Spark plasma sintering system 200 includes vacuum chamber 210 that contains assembly 100 as well as conductive plates 220 and at least a portion of presses 230.

Presses 230 apply pressure to sintering can 100. The pressure may be up to 100 MPa, up to 80 MPa, or up to 50 MPa. Prior to or after pressure is applied, vacuum chamber 210 may be evacuated or filled with an inert gas. If sintering can 100 is filled with reactant gas 80 and sealed in vacuum chamber 210, then before substantial pressure is applied, chamber 210 is evacuated and filled with reactant gas, then port 120 is sealed. Pressure may be applied before or after chamber 210 is evacuated again and/or filled with inert gas.

After vacuum chamber 210 is prepared, a voltage and amperage is applied between electrically conductive plates 220 sufficient to heat reactant gas 80 to a temperature at which reactant gas 80 within pores 50 and 70 forms a plasma. For example, the temperature of the reactant gas may be 1500° C. or below, 1200° C. or below, 700° C. or below, between 300° C. and 1500° C., between 300° C. and 1200° C., or between 300° C. and 700° C. The temperature may be below 1200° C. or below 700° C. to avoid graphitization of diamond in polycrystalline diamond 30.

The voltage and amperage are supplied by a continuous or pulsed direct current (DC). The current passes through electrically conductive components of assembly 100, such as sealed sintering can 110 and, if electrically conductive, polycrystalline diamond 30 and/or substrate 40. The current density may be at least $0.5\times10^2$ A/cm$^2$, or at least $10^2$ A/cm$^2$. The amperage may be at least 600 A, as high as 6000 A, or between 600 A and 6000 A. If the current is pulsed, each pulse may last between 1 millisecond and 300 milliseconds.

The passing current heats the electrically conductive components, causing reactant gas 80 to reach a temperature, as described above, at which it forms a plasma. The plasma formed from reactant gas 80 contains reactive species, such as atomic hydrogen, protons, methyl, carbon dimmers, and metal ions, such as titanium ions ($Ti^{4+}$), vanadium ions ($V^{4+}$), and any combinations thereof. The reactive species derived from hydrogen gas or hydrocarbon gas form diamond bonds 90. The metal reactive species form carbide structures 100, at least a portion of which covalently bond to both diamond grains 10 and carbide grains 60.

Because spark plasma sintering heats assembly 100 internally as the direct current passes, it is quicker than external heating methods for forming a plasma. Assembly 100 may also be pre-heated or jointly heated by an external source, however. The voltage and amperage may only need to be applied for 20 minutes or less, or even for 10 minutes or less, or 5 minutes or less to form a spark plasma sintered PDC. The rate of temperature increase of assembly 100 or a component thereof while the voltage and amperage are applied may be at least 300° C./minute, allowing short sintering times. These short sintering times avoid or reduce thermal degradation of the polycrystalline diamond.

Figure 4:
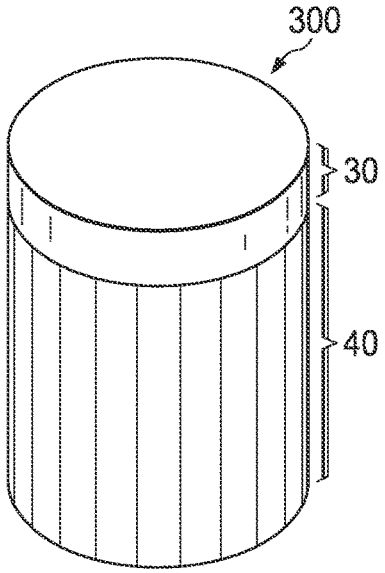
FIG. 4 is a schematic drawing of a PDC cutter formed by spark plasma sintering.

The resulting PDC containing covalently bonded polycrystalline diamond 30 and substrate 40 may in the form of a cutter 300 as shown in FIG. 4. Although the interface between polycrystalline diamond 30 and substrate 40 is shown as planar in FIG. 4, the interface may have any shape and may even be highly irregular. In addition, although PDC cutter 300 is shown as a flat-topped cylinder in FIG. 4, it may also have any shape, such as a cone or wedge. Polycrystalline diamond 30 and/or substrate 40 may conform to external shape features. Furthermore, although polycrystalline diamond 30 and substrate 40 are illustrated as generally uniform in composition, they may have compositions that vary based on location. For instance, polycrystalline diamond 30 may have regions with different levels of leaching or different diamond grains (as described above), including different grain sizes in different layers. Substrate 40 may include reinforcing components, and may have different carbide grain sizes.

If polycrystalline diamond 30 in PDC cutter 300 is thermally stable prior to its attachment to substrate 40, it may remain thermally stable after attachment, or experience a much lesser decrease in thermal stability than is typically experienced if an elemental metal or metal alloy is reintroduced during attachment because the carbide structures do not negatively affect thermal stability to the degree elemental metals or metal alloys do.

Furthermore, if there is reason to further leach polycrystalline diamond 30 after its attachment to substrate 40, such additional leaching may be performed. Although care may be taken to avoid dissolving or damaging the carbide structures that covalently bond polycrystalline diamond 30 to substrate 40, these structures may be more resistant to dissolution or damage than elemental metal or metal alloy structures.

Figure 5:
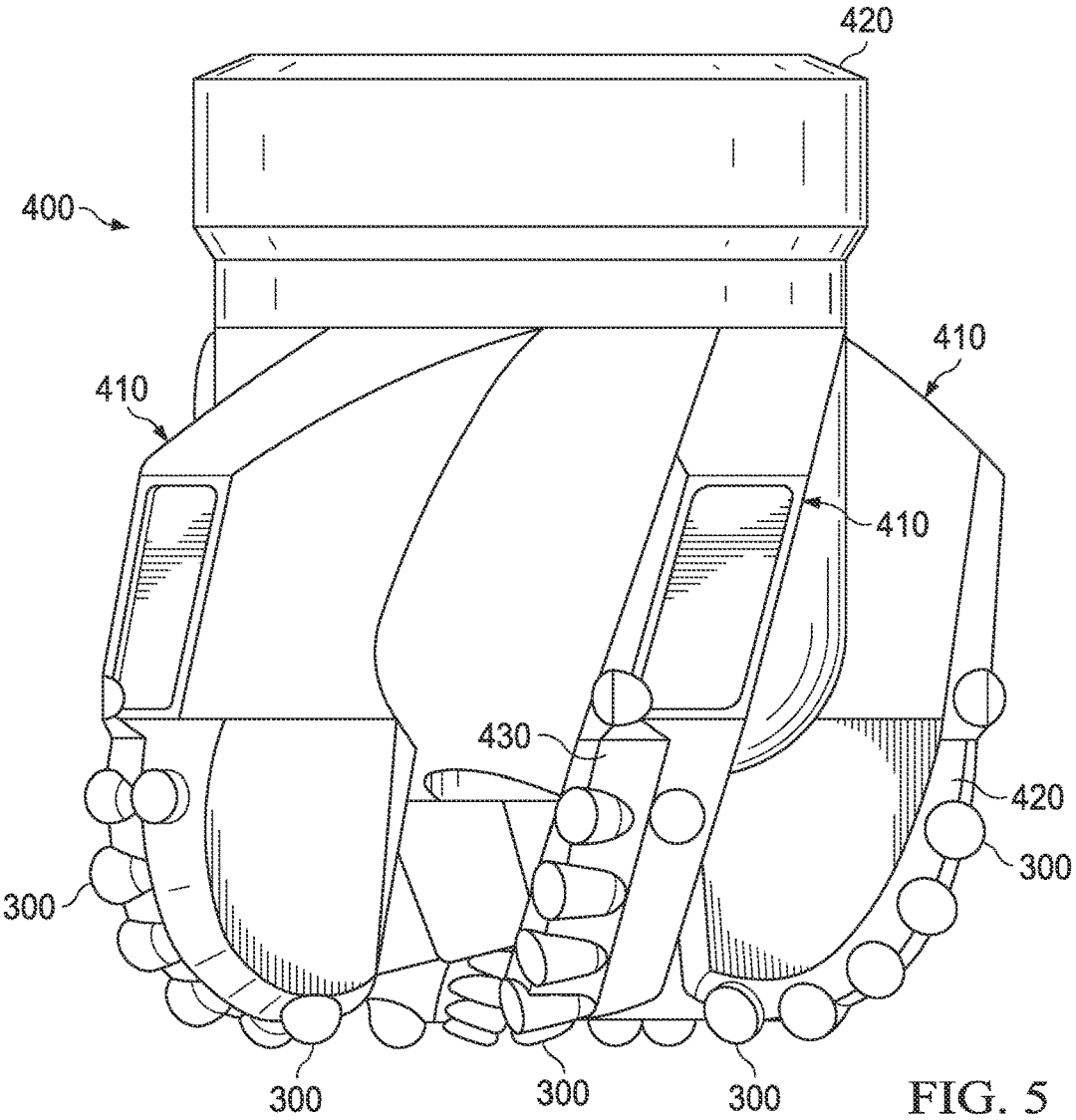
FIG. 5 is a schematic drawing of a fixed cutter drill bit containing a PCD cutter formed by spark plasma sintering.

A PDC cutter such as cutter 300 may be incorporated into an earth-boring drill bit, such as fixed cutter drill bit 400 of FIG. 5. Fixed cutter drill bit 400 contains a plurality of cutters coupled to drill bit body 420. At least one of the cutters is a spark plasma sintered PDC cutter 300 as described herein. As illustrated in FIG. 5, a plurality of the cutters are cutters 300 as described herein. Fixed cutter drill bit 400 includes bit body 420 with a plurality of blades 410 extending therefrom. Bit body 420 may be formed from steel, a steel alloy, a matrix material, or other suitable bit body material desired strength, toughness and machinability. Bit body 420 may also be formed to have desired wear and erosion properties. PDC cutters 300 may be mounted on blades 410 or otherwise on bit 400 and may be located in gage region 430, or in a non-gage region, or both.

Drilling action associated with drill bit 400 may occur as bit body 420 is rotated relative to the bottom of a wellbore. At least some PDC cutters 300 disposed on associated blades 410 contact adjacent portions of a downhole formation during drilling. These cutters 300 are oriented such that the polycrystalline diamond contacts the formation.

Spark plasma sintered PDC other than that in PCD cutters may be attached to other sites of drill bit 400 or other earth-boring drill bits. Suitable attachment sites include high-wear areas, such as areas near nozzles, in junk slots, or in dampening or depth of cut control regions.

The present disclosure provides an embodiment A relating to a method of covalently bonding polycrystalline diamond and a substrate via a cemented carbide, by placing polycrystalline diamond having pores adjacent a cemented carbide substrate with a reactant gas including a carbide-forming metal in gas form adjacent one another with a reactant gas comprising a hydrocarbon gas form in an assembly, and applying a voltage between the conductive plates sufficient to heat the reactant gas to a temperature of 1500° C. or less at which the reactant gas forms a plasma, which plasma forms carbide structures in at least a portion of the PCD pores, wherein the carbide structures are covalently bonded to the cemented carbide substrate.

The present disclosure further provides an embodiment B relating to a PDC element including polycrystalline diamond having pores adjacent a cemented carbide substrate and carbide structures in at least a portion of the pores and covalently bonded to the cemented carbide substrate.

The disclosure further relates to an embodiment C relating to any PDC element formed using the method of embodiment A.

The present disclosure further provides and embodiment D relating to a fixed cutter drill but including a PDC element of embodiments B or C.

In addition, embodiments A, B, C and D may be used in conjunction with the following additional elements, which may also be combined with one another unless clearly mutually exclusive, and which method elements may be used to obtain devices and which device elements may result from methods: i) the polycrystalline diamond may include a leached portion in which less than 2% of the volume is occupied by a diamond sintering aid; ii) the carbide-forming metal in gas form may include a metal salt; iii) the plasma may include metal ions; iv) the reactant gas may further include a hydrocarbon gas; v) the plasma may include atomic hydrogen, a proton, or a combination thereof; vi) the reactant gas may further include a hydrocarbon gas; vii) the hydrocarbon gas may include methane, acetone, methanol, or any combinations thereof; viii) the plasma may include methyl, carbon dimmers, or a combination thereof; ix) the temperature may be 1200° C. or less; x) the temperature may be 700° C. or less; xi) the voltage and amperage may be supplied by a continuous direct current or a pulsed direct current; xii) the voltage and amperage may be applied for 20 minutes or less; xiii) the sintering can, polycrystalline diamond, substrate, reactant gas, or any combination thereof may have a rate of temperature increase while the voltage and amperage are applied of least 300° C./minute; xiv) diamond bonds, carbide structures, or both may be formed in at least 25% of the pores of the polycrystalline diamond xv) the PDC element may include diamond bonds, carbide structures, or both in at least 25% of its pores; xvi) the PDC element may be a cutter; xvii) the PDC element may be an erosion resistant element.

Although the present disclosure and its advantages have been described in detail, it should be understood that various changes, substitutions and alternations can be made herein without departing from the spirit and scope of the disclosure as defined by the following claims.

What is claimed is:

1. A method of covalently bonding polycrystalline diamond and a substrate via a cemented carbide, the method comprising:

placing polycrystalline diamond (PCD) having pores adjacent a cemented carbide substrate with a reactant gas including a carbide-forming metal in gas form in an assembly;

and applying a voltage to the assembly sufficient to heat the reactant gas to a temperature of 1500° C. or less at which the reactant gas forms a plasma, which plasma forms carbide structures in at least a portion of the PCD pores, wherein the carbide structures are covalently bonded to the cemented carbide substrate, wherein the PCD, substrate, reactant gas, or any combination thereof have a rate of temperature increase while the voltage is applied of at least 300° C./minute.

2. The method of claim 1, wherein the PCD comprises a leached portion in which less than 2% of the volume is occupied by a diamond sintering aid.

3. The method of claim 1, wherein the carbide-forming metal in gas form comprises a metal salt.

4. The method of claim 3, wherein the metal salt comprises a metal chloride.

5. The method of claim 1, wherein the carbide structures comprise zirconium carbide (ZrC), titanium carbide (TiC), silicon carbide (SiC), vanadium carbide (VC), chromium carbide (CrC), boron carbide (BC), tungsten carbide (WC), tantalum carbide (TaC), manganese carbide (MnC), nickel carbide (NiC), molybdenum carbide (MoC), halfnium carbide (HfC), rhenium carbide (ReC), and any combinations thereof.

6. The method of claim 1, wherein plasma comprises metal ions.

7. The method of claim 1, wherein the reactant gas comprises hydrogen gas.

8. The method of claim 7, wherein the plasma comprises atomic hydrogen, a proton, or a combination thereof.

9. The method of claim 1, wherein the reactant gas further comprises a hydrocarbon gas.

10. The method of claim 9, wherein the hydrocarbon gas comprises methane, acetone, methanol, or any combinations thereof.

11. The method of claim 9, wherein the plasma comprises methyl, carbon dimmers, or a combination thereof.

12. The method of claim 1, wherein the voltage is supplied by a continuous direct current or a pulsed direct current.

13. The method of claim 1, wherein the voltage is supplied for 20 minutes or less.

14. The method of claim 1, wherein diamond bonds, carbide structures, or both are formed in at least 25% of the pores of the PCD.

15. The method of claim 1, wherein the temperature is 1200° C. or less.

16. The method of claim 1, wherein the temperature is 700° C. or less.

17. The method of claim 1, further comprising, prior to applying the voltage:

placing the assembly in a sealed, electrically conductive sintering can;

placing the sintering can between presses and in electrical contact with electrically conductive plates in a vacuum chamber;

evacuating the vacuum chamber; and applying pressure to the sintering can with the presses sufficient to drive the reactant gas into at least a portion of the pores of the PCD.

18. The method of claim 1, further comprising:

dissolving a portion of the substrate using an acid to introduce pores near a surface of the substrate placed adjacent the PCD, in which the carbide structures are later covalently bonded.

19. The method of claim 1, wherein the substrate further comprises carbide grains adjacent the PCD to which the carbide structures are covalently bonded.

20. A method of covalently bonding polycrystalline diamond and a substrate via a cemented carbide, the method comprising:

placing polycrystalline diamond (PCD) having pores and comprising a leached portion in which less than 2% of the volume is occupied by a diamond sintering aid adjacent a cemented carbide substrate with a reactant gas including a carbide-forming metal in gas form and a hydrogen gas or a hydrocarbon gas in an assembly;

and applying a voltage to the assembly sufficient to heat the reactant gas to a temperature of 1500° C. or less at which the reactant gas forms a plasma, which plasma forms carbide structures in at least a portion of the PCD pores, wherein the carbide structures are covalently bonded to the cemented carbide substrate, wherein the PCD, substrate, reactant gas, or any combination thereof have a rate of temperature increase while the voltage is applied of at least 300° C./minute.

* * * * *